US007044419B2

(12) United States Patent
Moore

(10) Patent No.: US 7,044,419 B2
(45) Date of Patent: May 16, 2006

(54) ROTATING TRANSFER TAPE DISPENSER

(76) Inventor: Timothy G. Moore, 3150 Waterford Dr., Lewis Center, OH (US) 43035

( * ) Notice: Subject to any disclaimer, the term of this patent is extended or adjusted under 35 U.S.C. 154(b) by 62 days.

(21) Appl. No.: 10/756,747

(22) Filed: Dec. 5, 2003

(65) Prior Publication Data

US 2004/0135026 A1 Jul. 15, 2004

Related U.S. Application Data

(63) Continuation-in-part of application No. 10/002,879, filed on Dec. 5, 2001, now abandoned.

(51) Int. Cl.
*B65H 49/00* (2006.01)

(52) U.S. Cl. ..... 242/559.2; 242/594.6

(58) Field of Classification Search ..... 242/594, 242/594.1, 594.2, 594.3, 594.4, 594.5, 594.6, 242/591, 560, 559.2, 559.3
See application file for complete search history.

(56) References Cited

U.S. PATENT DOCUMENTS

| | | | | | |
|---|---|---|---|---|---|
| 505,532 | A * | 9/1893 | McManis | ..... | 242/594.6 |
| 585,070 | A * | 6/1897 | Yeakel | ..... | 242/594.6 |
| 840,702 | A * | 1/1907 | Maloney | ..... | 242/594.6 |
| 1,379,154 | A * | 5/1921 | Bullis | ..... | 242/594.6 |
| 1,462,333 | A * | 7/1923 | Girard | ..... | 242/594.6 |
| 1,684,037 | A * | 9/1928 | Leedy | ..... | 242/594.3 |
| 1,931,276 | A * | 10/1933 | Warner | ..... | 242/594.6 |
| 3,920,194 | A * | 11/1975 | Parsen | ..... | 242/594.4 |
| 6,152,392 | A * | 11/2000 | Hawkins | | |
| 6,235,369 | B1 * | 5/2001 | Shepard et al. | | |
| 6,419,175 | B1 * | 7/2002 | Rankin, VI | | |

* cited by examiner

*Primary Examiner*—William A. Rivera
(74) *Attorney, Agent, or Firm*—David A. Greenlee

(57) ABSTRACT

A rotating transfer tape dispensing device mounts to a table top surface to allow application of transfer tape to a sheet of "weeded" vinyl for use in the sign industry. The device is a rotating assembly of four spaced rods that each accept any combination of different-width transfer tape rolls up to 120" in total width. Each rod is rotatable to, and lockable in, a left- or right-hand dispensing position. The rods are mounted for quick insertion and removal to enable rapid change of tape rolls.

4 Claims, 3 Drawing Sheets

ROTATING TRANSFER TAPE DISPENSER

RELATED APPLICATIONS

This application is a continuation in part of U.S. patent application Ser. No. 10/002,879, filed Dec. 5, 2001, now abandoned, which claims priority of U.S. Provisional Patent Application No. 60/252,674, filed Nov. 22, 2000, both of which are incorporated herein in their entirety by reference.

FIELD OF THE INVENTION

This invention relates to a rotating transfer tape dispenser/applicator used for dispensing transfer tape onto a weeded piece of vinyl as used in the sign industry.

BACKGROUND OF THE INVENTION

The use of devices to dispense transfer tape is well known in the sign industry. The conventional sign shop process is to use a cutting machine to cut lettering out of rolls of adhesive-backed vinyl using a design in a computer. After the letters are cut, the excess vinyl is pulled away, leaving the letters on the backing sheet. The letters must be transferred in their pre-spaced format to a substrate. The substrate can be a vehicle door, banner, wood signboard, glass door/window or anything else that letters will stick to. It is necessary to transfer these letters all in their pre-spaced format to the substrate. The method used is covering the letters with a sheet of transfer tape and then removing the backing to apply the "decal" to the substrate.

Various manual devices are available on the market to dispense transfer tape for use in sign shops. These devices range from those made "in house", which use a simple rod and holder to hold a single roll of tape, to those commercially available with two rods. The problem has long existed in the industry is inability to match the backing tape available with the variety of letter sizes used. Thus, while a vinyl graphic may only be 2" wide, the roll of transfer loaded on the rod may be 24" wide, therefore wasting 22" of transfer tape. It is possible to load the single or double rod with multiple sizes of tape, but that combination only allows a total of 36" or 72" of transfer tape. The major problem that exists is that it is sometimes necessary to unload an unwanted width of transfer tape and reload the proper width to prevent wasting tape or having to apply two widths to cover large graphics.

It would be desirable to provide a tape dispensing device which provides the proper backing tape width without having to change rolls, and preventing the wasting of tape.

SUMMARY OF THE INVENTION

It is therefore an object of this invention to provide a tape dispensing device which provides the proper backing tape width without having to change rolls, and preventing the wasting of tape. Since it is common to use a left- or right-hand dispensing arrangement, with the dispenser at the respective right and left ends of the table, it is necessary for such a device to accommodate both.

This invention features a rotating transfer tape dispensing device that mounts to either end of a table top surface. It is designed to allow application of transfer tape to a sheet of "weeded" vinyl for use in the sign industry. It consists of a rotating assembly that allows any combination up to 120" of transfer tape of assorted sizes to be loaded at any one time. This precludes the necessity of changing tape rolls in the machine when a different size tape is needed. By simply rotating the wheel the user can select the size of tape needed.

In one aspect, this invention features method of conserving transfer tape by dispensing the tape from one of a plurality of different-width rolls that most closely matches the width desired, comprising the steps of mounting a plurality of different width rolls of tape on a plurality of transversely-oriented rods mounted in spaced relation on a unit that is rotatable about a transverse axis, said rolls being selectively oriented for left- or right-hand direction of dispensing tape from the unit, mounting the unit on a table in a position to accommodate a selected dispensing direction, indexing the unit to locate a rod mounting a selected roll into a dispensing position for selected left- or right-hand dispensing, locking the rod in said position, and dispensing the tape.

In another aspect, this invention features a transfer tape dispensing device that mounts to a table top surface to allow application of transfer tape to a sheet of vinyl for use in the sign industry, said device comprising a base, a rotatable unit comprising a pair of spaced end plates supported on the base for rotation about a transverse axis, a plurality of spaced rods extending between the end plates, means mounting each rod for quick installation and removal, said rods accepting a variety of different-width transfer tape rolls for dispensing therefrom, and locking means for locking the rotatable unit in a plurality of dispensing positions, said positions accommodating dispensing of tape from each rod in a selected left- or right-hand direction of dispensing tape from the unit.

These and other objects and features of this invention will become more readily apparent upon reading the following detailed description in conjunction with the attached drawings, in which:

DRAWING DESCRIPTION

DETAILED DESCRIPTION OF THE INVENTION

Figure 1:
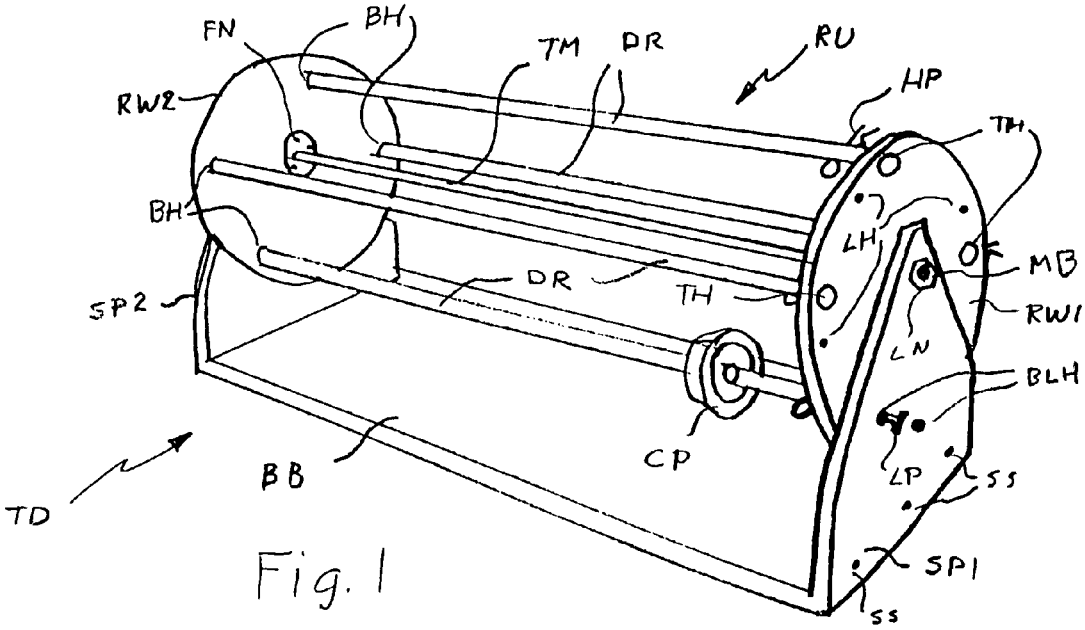
FIG. 1 is a perspective view of the dispenser of this invention, shown before loading tape rolls.
Figure 2:
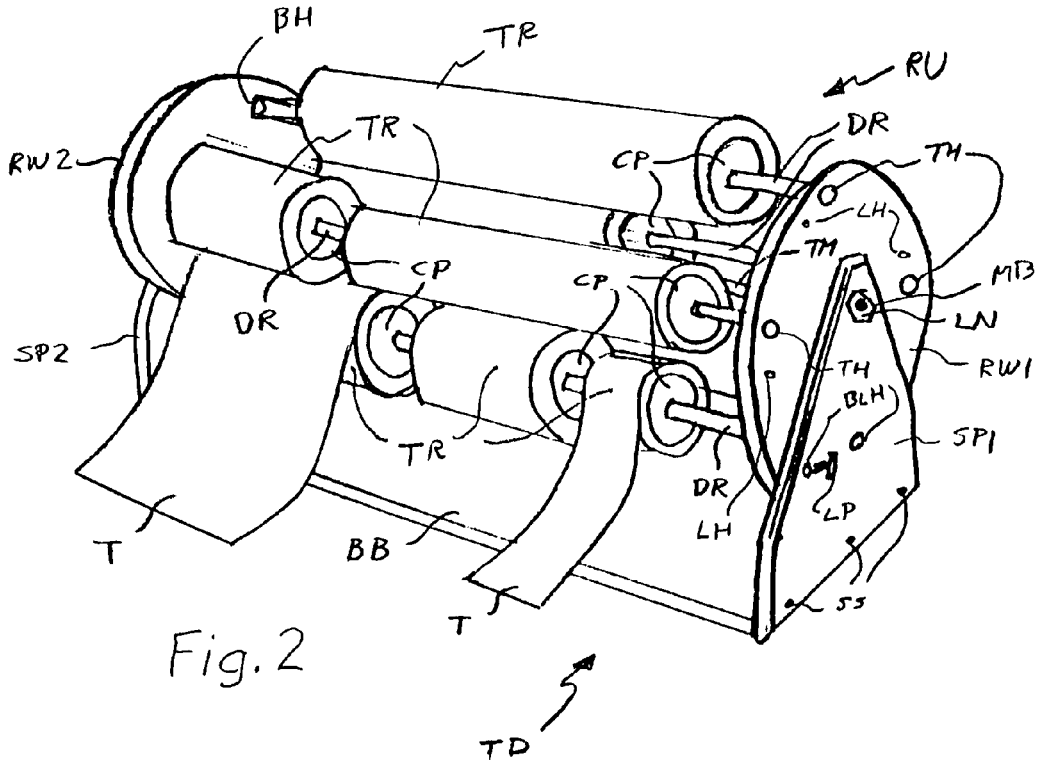
FIG. 2 is a view similar to FIG. 1, but shown with rolls of tape loaded.
Figure 3:
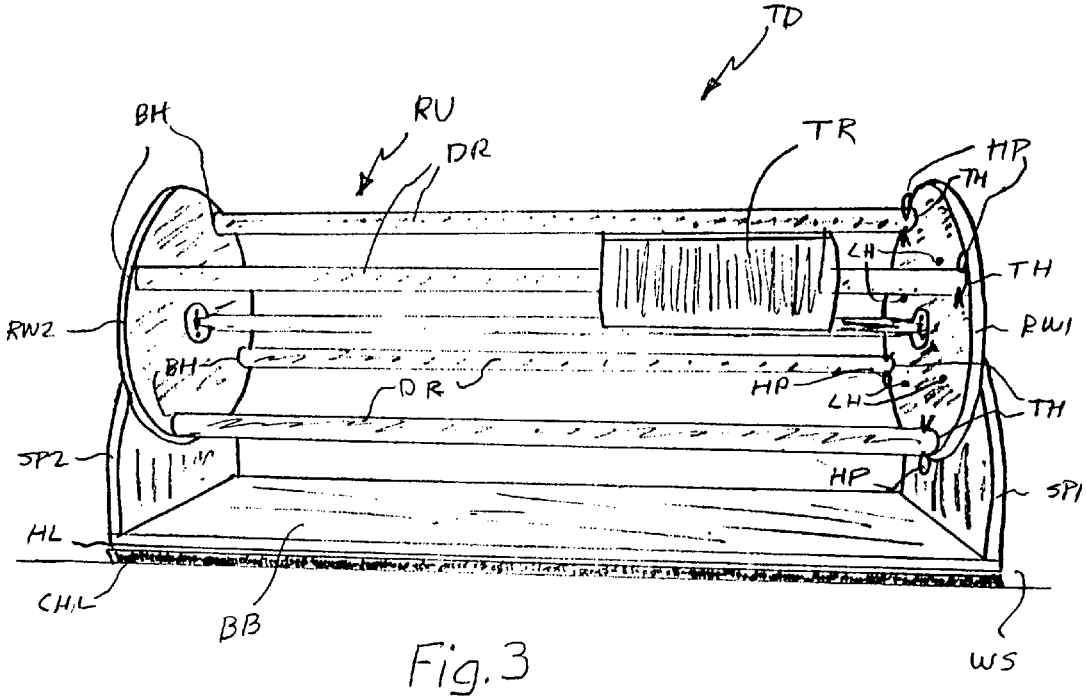
FIG. 3 is a plan view of the dispenser of FIGS. 1 and 2.

Referring to FIGS. 1 and 2 of the drawings, a rotating transfer tape dispenser/applicator device TD dispenses multiple assorted width rolls TR of transfer tape T. The device TD is an assembly made up of base support BB having spaced, upstanding side panels SP1 and SP2, each secured to base. BB by screws SS and each mounting metal bushings MB, and a rotatable unit RU.

Rotatable unit RU is made up of seven different types of parts: namely, dowel rods DR, a threaded main shaft TM, end plates RW1 and RW2 (with small bushings), locking nuts LN, flange nuts FN, hitch pins HP and core plugs CP.

Base BB is preferably rectangular and made of a rigid material such as plastic, wood, or metal. The rotatable unit RU holds the four dowel rods DR that are preferably made of wood or metal and the threaded main shaft TM preferably made of metal.

The bottom base support BB and the side panels SP1 and SP2 are assembled together with side panel screws SS forming the base. The two end plates RW1 and RW2 are secured onto each end of the threaded main shaft TM and locked into place with the lock nuts LN against flange nuts FN, which are screwed into the side panels RW so as to form one rigid assembly. With part of the threaded main shaft TM protruding out of the end on each end plates RW, the assembly is inserted into the side panels SP1 and SP2 and lock nuts LN are attached on the outside of the side panels SP1 and SP2 to secure the end plates assembly with small bushings SB inserted.

Four dowel rods DR are inserted into the end plates RW1 and RW2 to support the rolls of tape or other material. The dowel rods DR are secured in place on one end by drilling part way through end plate RW2 to create blind holes BH. The other end is drilled all the way through end plate RW1 to create through holes TH. The rods and secured with removable hitch pins HP that are inserted through a diametral hole in the rods to allow the dowel rod DR to be removed and loaded with rolls of tape or other material using the 3" core plugs CP. The end plates RW and assembly are then rotated to select the width of tape or other material desired and the end plates RW is locked into place with the locking pin LP. (20) 3" core plugs CP are provided to insert into rolls of tape or other material supplied by the user.

Figure 5:
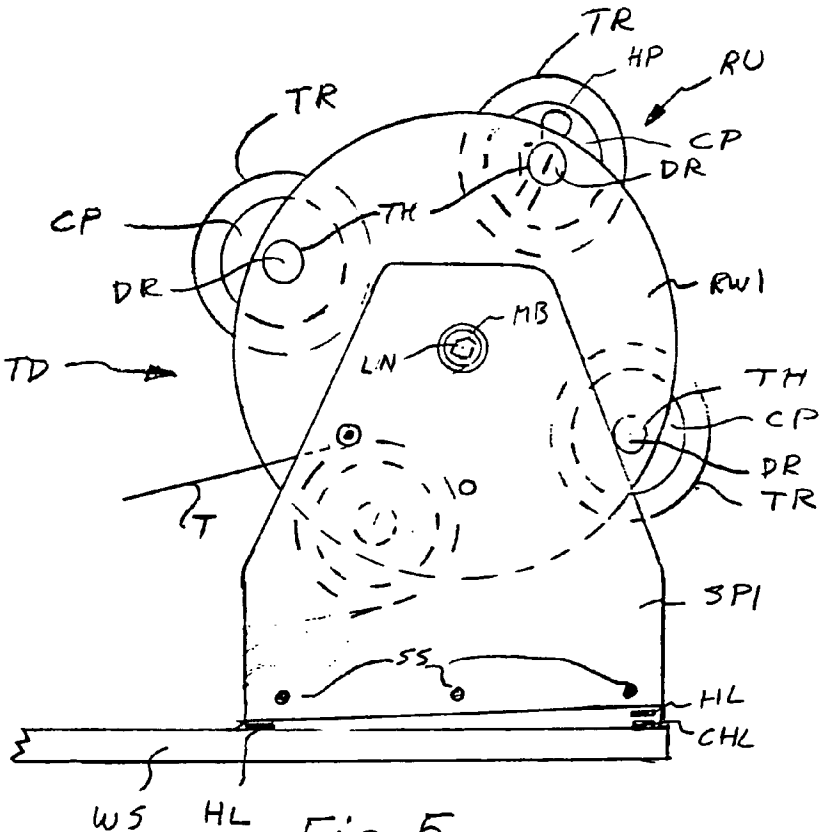
FIG. 5 is an end view similar to FIG. 4, but with the dispenser shown mounted for left-hand dispensing.
Figure 4:
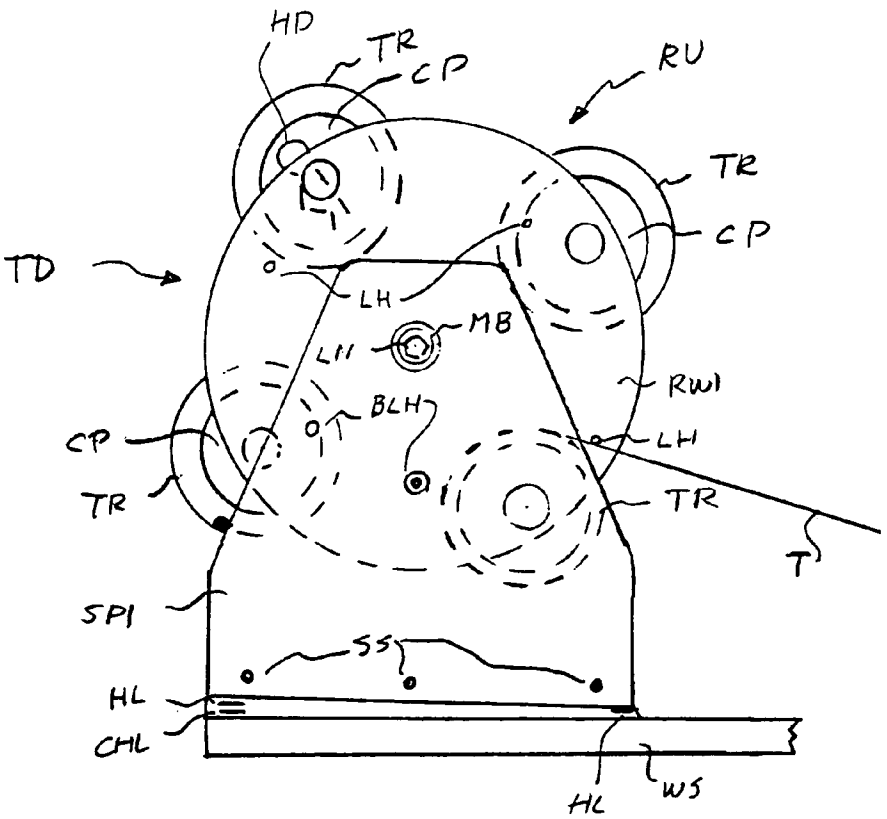
FIG. 4 is an end view of the dispenser of FIGS. 1–3, mounted on a table for right-hand dispensing.

Tape rolls TR of various width tapes are rotatably mounted on rods DR by core plugs CP, as shown in FIGS. 2, 4 and 5. To install or remove rolls TR from any rod DR, hitch pin HP is removed and rod DR withdrawn from the blind hole BH and partially withdrawn through a through hole TH. This enables the core plugs CR tape rolls TR to be easily installed on or removed from rod DR. Then the rod DR is slid back through hole TR and into hole BH and hitch pin HP is reinstalled. This enable quick installation and removal of tape rolls TR from rods DR he core plugs CP slide over the dowel rods DR. In this manner, any variety of tape roll widths can be installed on each rod DR, a greater variety on all rods DR, as shown in FIG. 2. Thus, the sign maker is able to use the right width tape for each successive job without wasting tape, by using the wrong-size tape, or having to remove and replace the roll, which wastes time.

Sign makers usually have a preference for the direction tape is fed onto the work surface. Some prefer a right-hand feed, as shown in FIG. 4, where the dispenser TD is mounted at the left side of a work surface or table WS, and secured in place, preferably, by cooperating hook-and-loop fasteners HL (mounted on bottom BB) and HLT (mounted on table WS). As illustrated, tape T is fed off the top of the roll TR. In operation, tape T is grasped with the right hand and pulled from dispenser TD over work surface or table WS and squeegeed or applied with the left hand to the sign. It has been found that operation of device TD in sign making is facilitated by locating roll TD in the low position illustrated. End plate RW1 is provided with a locating hole LH mounted adjacent each rod DR, while side panel SP1 includes spaced locking holes BLH. As illustrated in FIG. 4, one of the locating holes LH is aligned with the left Locking hole BLH, and a locking pin LP is inserted through the aligned holes to lock rotatable unit RU in place.

If a left-hand feed, as in FIG. 5, is desired, the device TD is moved to the right end of table WS, and again secured in place by cooperating hook-and-loop fasteners HL and HLT. To provide the necessary top-of-roll feed, the rolls TR must be reversed, as shown. To assure that the proper roll position is attained, a locating hole. LH is aligned with the right Locking hole BLH and pin LP is inserted to lock rotatable unit RU in position for left-hand feed of tape T.

The use of hook-and-loop fasteners and the lightweight construction of the dispenser make it readily movable. It can easily be moved to another table or the other end of the table. Also, when the dispenser is not in use, it can be readily removed to open up further work space on the table.

Thus this invention provides a versatile tape dispensing unit for the sign maker that accommodates a wide variety of tape widths for immediate use, enables easy removal and installation of tape rolls, is portable and readily movable, and accommodates both right-and left-hand tape feed.

While only a preferred embodiment of this invention has been shown and described, many modifications will become rendered obvious to one skilled in the art, and are intended to be covered by the appended claims.

I claim:

1. A transfer tape dispensing device that mounts to a table top surface to allow application of transfer tape to a sheet of vinyl for use in the sign industry, said device comprising a base including a pair of spaced upstanding side panels, a rotatable unit comprising a pair of spaced end plates supported on the base for rotation about a transverse axis, a plurality of spaced rods extending between the end plates, means mounting each rod for quick installation and removal, said rods accepting a variety of different-width transfer tape rolls for dispensing therefrom, and locking means for looking the rotatable unit in a plurality of dispensing positions, said positions comprising two different positions for each unit, one of said positions accommodating dispensing of tape in a left-hand direction and the other said position accommodating dispensing of tape in a right-hand direction of dispensing tape from the unit, comprising a pair of spaced locking holes in one of the side panels, a locating hole located adjacent each rod in one of the end plates, one of said locking holes aligning with the locating hole for each rod to position a selected roll to facilitate dispensing of tape in one direction, and the other of said locking holes aligning with the locating hole for each rod position a selected roll to facilitate dispensing of tape in the other dispensing direction, and a pin insertable in the aligned holes to lock the rotatable unit in position.

2. The transfer tape dispensing device of claim 1, wherein the rotatable unit includes a central shaft that mounts the side plates for rotation therewith and is journaled in the side plates to define the transverse axis.

3. The transfer tape dispensing device of claim 1, wherein the rod mounting means each include a plurality of spaced blind holes in one of the end plates, each receiving one end of a rod, a plurality of aligned mating through holes in the other end plate for receiving the rods therethrough, and rod securing means for securing the other rod ends to the other end plate against removal.

4. The transfer tape dispensing device of claim 1, including cooperating mounting means on a support surface and on the base for removably positioning the unit on the support surface.

* * * * *